US005597333A

United States Patent [19]

Soda

[11] Patent Number: 5,597,333

[45] Date of Patent: Jan. 28, 1997

[54] TRIM SYSTEM FOR OUTBOARD ENGINE SYSTEM

[75] Inventor: Chiharu Soda, Wako, Japan

[73] Assignee: Honda Giken Kogyo Kabushiki Kaisha, Tokyo, Japan

[21] Appl. No.: 532,453

[22] Filed: Sep. 22, 1995

[30] Foreign Application Priority Data

Sep. 26, 1994 [JP] Japan ..... 6-230071

[51] Int. Cl.[6] ..... B63H 21/26

[52] U.S. Cl. ..... 440/61

[58] Field of Search ..... 440/53, 61; 411/426

[56] References Cited

U.S. PATENT DOCUMENTS

| | | | |
|---|---|---|---|
| 3,849,964 | 11/1974 | Briles | 411/426 |
| 4,720,278 | 1/1988 | Taguchi et al. | 440/61 |
| 4,764,134 | 8/1988 | Watanabe | 440/61 |

FOREIGN PATENT DOCUMENTS

| | | | |
|---|---|---|---|
| 219498 | 9/1988 | Japan | 440/61 |

*Primary Examiner*—Jesus D. Sotelo

*Attorney, Agent, or Firm*—Nikaido, Marmelstein, Murray & Oram LLP

[57] ABSTRACT

In a trim system for an outboard engine system, a thrust receiver abuts against an output rod of a trim cylinder which is fixed to a stern bracket. The thrust receiver includes a thrust receiver body which is fitted in a mounting hole defined in a swivel case. The thrust receiver body is fixed by a nut. A steel ball is rotatably supported at a tip end of the thrust receiver body and rollable on an abutment surface of the output rod. The thrust receiver body includes a mounting shaft portion which has a first tapered surface. The first tapered surface is wedged to a second tapered surface formed in the mounting hole, thereby causing the mounting shaft portion and the mounting hole to smoothly abut against each other. Thus, it is possible to prevent the thrust receiver mounted on the swivel case from chattering relative to the swivel case.

11 Claims, 5 Drawing Sheets

TRIM SYSTEM FOR OUTBOARD ENGINE SYSTEM

BACKGROUND OF THE INVENTION

1. Field of the Invention

The present invention relates to a trim system for an outboard engine system, including a swivel case on which an outboard engine body is pivotally supported through a swivel shaft, such that the outboard engine body can be laterally steered. The swivel case is vertically swingably supported on a stern bracket through a tilting shaft. A trim cylinder is mounted on the stern bracket. The trim cylinder has an output rod provided thereon to abut against a thrust receiver which is mounted on the swivel case.

2. Description of the Prior Art

A trim system for an outboard engine system is already known from Japanese Utility Model Application Laid-open No. 122996/91. In this trim system, a mounting shaft portion of the thrust receiver is fitted into a mounting hole in the swivel case and fixed by a nut.

During operation of the outboard engine system, vibration of the engine is applied to an abutment of the thrust receiver against the output rod of the trim cylinder. During acceleration of the outboard engine system or during high-speed operation of the outboard engine system, a large thrust is applied to the abutment. In the known system, however, when a large thrust is applied to the abutment, a load is applied unevenly to the mounting shaft portion due to a manufacture looseness, thereby obstructing the smooth abutment of the thrust receiver against the swivel case, because the mount shaft portion of the thrust receiver is merely fitted into the mounting hole in the swivel case and fixed by the nut.

SUMMARY OF THE INVENTION

Accordingly, it is an object of the present invention to ensure that the thrust receiver is reliably placed into abutment against the swivel case.

To achieve the above object, according to a first aspect and feature of the present invention, there is provided a trim system for an outboard engine system, comprising a swivel case on which an outboard engine body is pivotally supported through a swivel shaft, such that the outboard engine body can be laterally steered. The swivel case is vertically swingably supported on a stern bracket through a tilting shaft. A trim cylinder is mounted on the stern bracket and has an output rod provided thereon to abut against a thrust receiver which is mounted on the swivel case. The thrust receiver includes a mounting shaft portion to be inserted into a mounting hole formed in the swivel case. The mounting shaft has a first tapered surface formed thereon and reduced in diameter in a direction away from the output rod of the trim cylinder. The mounting hole has a second tapered surface formed therein. The first tapered surface is wedged to the second tapered surface.

With the above construction, when a load such as vibration is applied from the output rod of the trim cylinder to the thrust receiver, the load is applied in a direction to cause the first tapered surface, formed on the mounting shaft portion of the thrust receiver, to be wedged to the second tapered surface formed on the swivel surface. Thus, it is possible to smoothly place the mounting shaft portion of the thrust receiver and the swivel case into abutment against each other without chattering.

According to a second aspect and feature of the present invention, in addition to the first feature, the thrust receiver is fixed to the swivel case by a nut threadedly fitted to the mounting shaft portion. The thrust receiver is prevented from being rotated by a detent means provided between the thrust receiver and the swivel case.

With the second feature of the present invention, when the nut is turned, the thrust receiver can be prevented from being rotated along with the nut, leading to an enhanced workability.

The above and other objects, features and advantages of the invention will become apparent from the following description of preferred embodiments taken in conjunction with the accompanying drawings.

DESCRIPTION OF THE PREFERRED EMBODIMENTS

The present invention will now be described by way of preferred embodiments with reference to the accompanying drawings.

Figure 1:
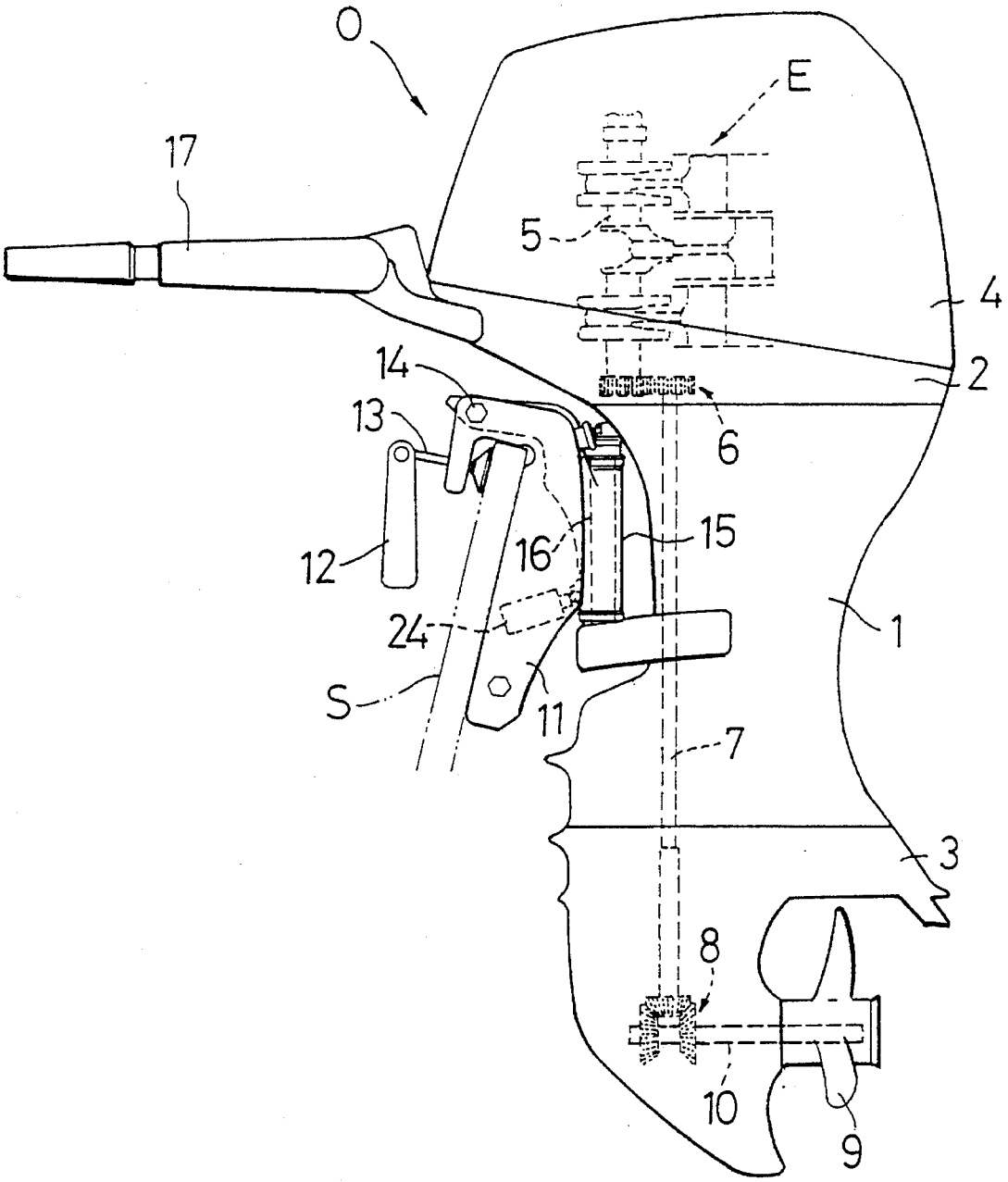
FIG. 1 is a view of the entire outboard engine system incorporating a trim system according to a first embodiment of the present invention.

Referring to FIG. 1, an outboard engine system includes an extension case 1, an under-case 2, a gear case 3 and an engine cover 4. A multi-cylinder vertical engine E is accommodated within the engine cover 4. A driving shaft 7 is connected to a lower end of the crankshaft 5 of the engine E, and extends downwardly within the extension case 1. A lower end of the driving shaft 7 is connected through a bevel gear mechanism 8 to a propeller shaft 10 having a propeller 9 at its rear end.

Figure 2:
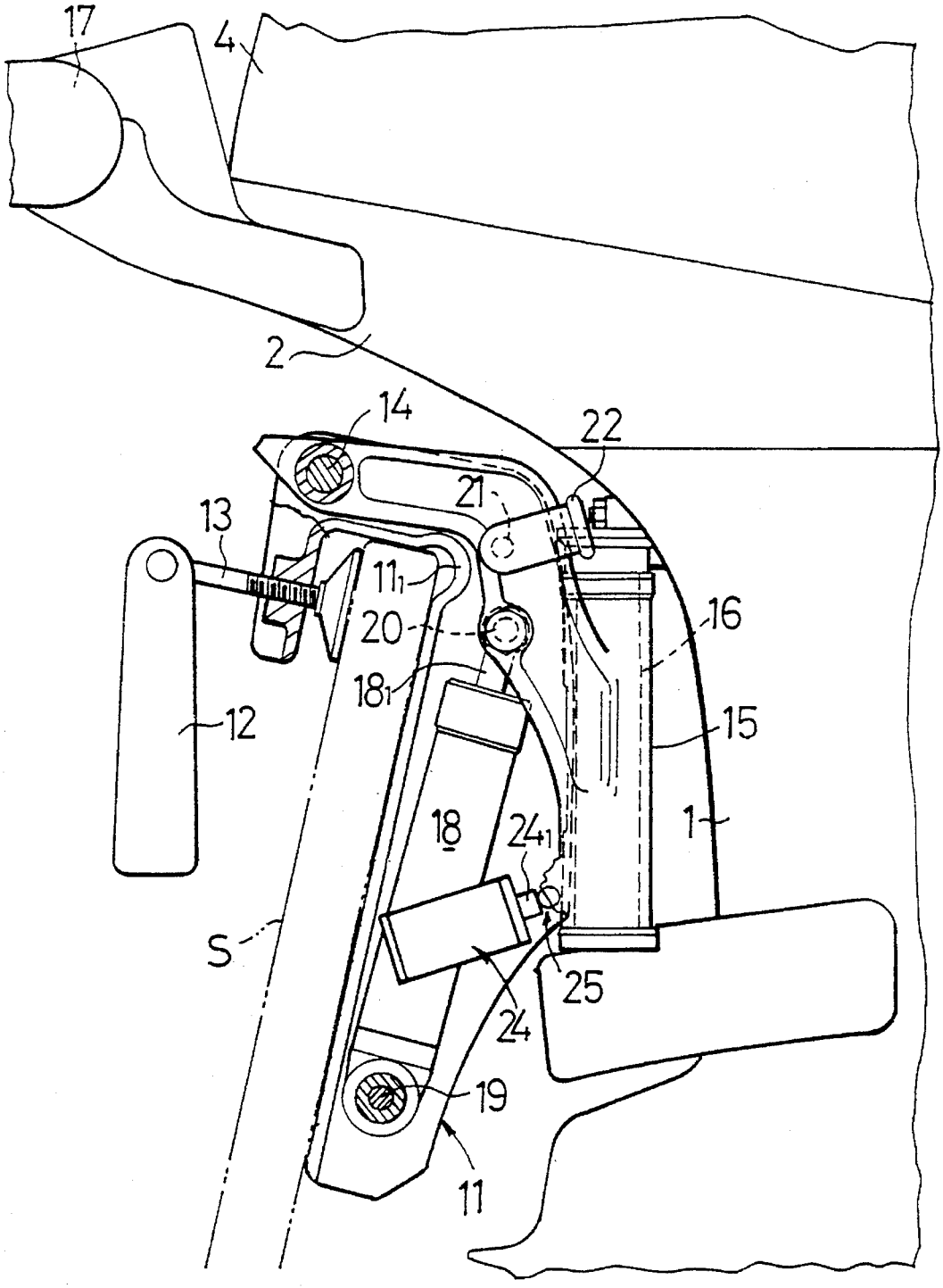
FIG. 2 is an enlarged view of an essential portion shown in FIG. 1.

As shown in FIG. 2, a stern bracket 11, detachably mounted at a stern S, is fixed by a set screw 13 operated by a lever 12, or by a bolt passed through a stern plate, in a state that a groove portion $\mathbf{11}_1$ having an opened lower end is engaged with the stern S. A swivel case 15 is vertically swingably supported on the stern bracket 11 through a tilting shaft 14, and a swivel shaft 16 is fixed to a front surface of the extension case 1 and rotatably fitted into the swivel case 15. Thus, an outboard engine body O can be steered about the swivel shaft 16 by operating a handle 17 mounted on a front surface of the under-case 2.

A tilting cylinder 18 is pivotally supported at its lower end on a lower portion of the stern bracket 11 through a pin 19. An output rod $\mathbf{18}_1$ of the tilting cylinder 18 is pivotally supported on the swivel case 15 through a pin 20. Thus, when the tilting cylinder 18 is expanded, the outboard engine body O is tilted up about the tilting shaft 14. At this time, a tilting movement stopper 22, pivotally supported on the swivel case 15 by a pivot 21, can be brought into abutment against an upper surface of the stern bracket 11 to fix the outboard engine body O at a tilted-up position by turning the stopper 22 from a stored position shown in FIG. 2 to an operative position shown in FIG. 3.

A trim cylinder 24 is integrally provided on a side of the tilting cylinder 18, and a thrust receiver 25 is mounted on a front surface of the swivel case 15, so that it is opposed to a tip end of an output rod $\mathbf{24}_1$ of the trim cylinder 24.

Figure 4:
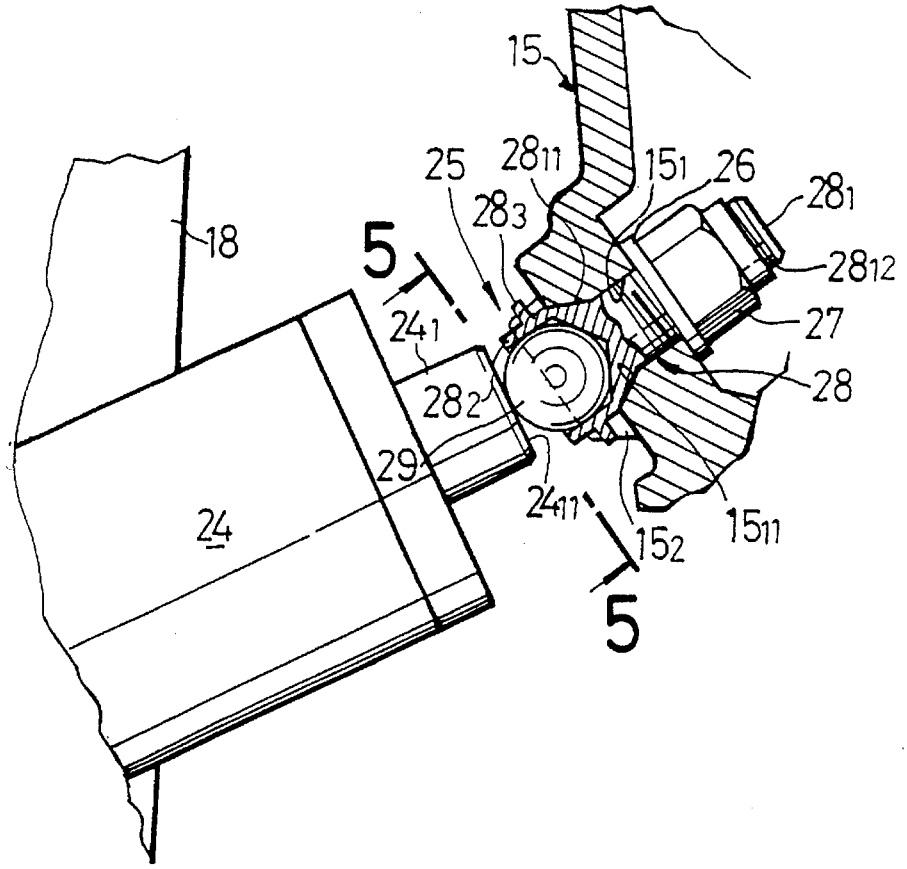
FIG. 4 is an enlarged view of an essential portion shown in FIG. 2.
Figure 5:
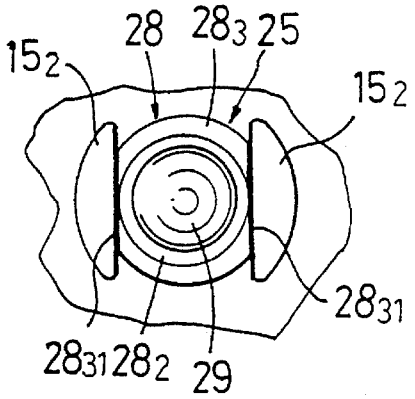
FIG. 5 is a view taken along a line 5—5 in FIG. 4.

As shown in FIGS. 4 and 5, the thrust receiver 25 includes a thrust receiver body 28 fixed to the swivel case 15 through a washer 26 and a nut 27. A steel ball 29 is supported at a front end of the thrust receiver body 28. The thrust receiver body 28 includes a mounting shaft portion $\mathbf{28}_1$ which has a first tapered surface $\mathbf{28}_{11}$ reduced in diameter in a rearward direction, and external threads $\mathbf{28}_{12}$ connected to a rear portion of the first tapered surface $\mathbf{28}_{11}$. On the other hand, a mounting hole $\mathbf{15}_1$ is defined in the swivel case 15 and has a second tapered surface $\mathbf{15}_{11}$ to which the first tapered surface $\mathbf{28}_{11}$ is fitted. By threadedly fitting the nut 27 over the external threads $\mathbf{28}_{12}$ on the mounting shaft portion $\mathbf{28}_1$, the thrust receiver body 28 is fixed to the swivel case 15 with the first tapered surface $\mathbf{28}_{11}$ of the mounting shaft portion of the thrust receiver body 28 being wedged to the second tapered surface $\mathbf{15}_{11}$ of the mounting hole $\mathbf{15}_1$ in the swivel case 15.

A short cylinder-like steel ball supporting portion $\mathbf{28}_2$ is integrally formed at the front portion of the first tapered surface $\mathbf{28}_{11}$ of the mounting shaft portion $\mathbf{28}_1$. The steel ball 29 is rotatably retained at the front end of the thrust receiver body 28 by fitting the steel ball 29 into the steel ball supporting portion $\mathbf{28}_2$ to caulk an opened end of the steel ball supporting portion $\mathbf{28}_2$. A flange $\mathbf{28}_3$ is integrally formed around an outer periphery of the steel ball supporting portion $\mathbf{28}_2$ and includes a pair of notches $\mathbf{28}_{31}$, $\mathbf{28}_{31}$ on left and right opposite sides thereof. These notches $\mathbf{28}_{31}$, $\mathbf{28}_{31}$ are engaged with a pair of left and right detent projections $\mathbf{15}_2$, $\mathbf{15}_2$ provided on the front surface of the swivel case 15.

The operation of the embodiment of the present invention having the above-described construction will be described below.

Figure 3:
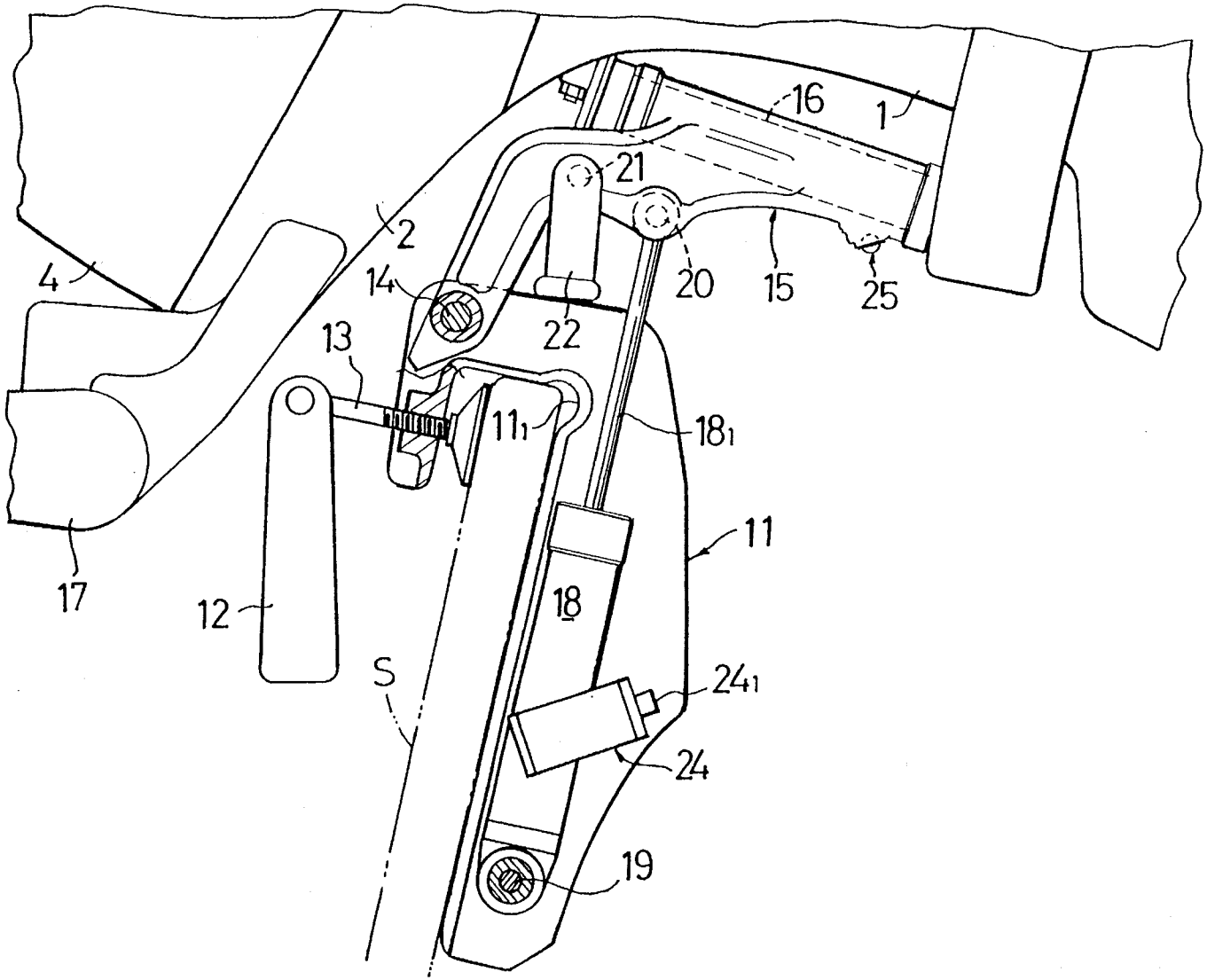
FIG. 3 is a view for explaining the operation.

In a condition in which the tilting cylinder 18 has been contracted to downwardly tilt the outboard engine body O, the swivel case 15 has been biased in a direction to swing forwardly about the tilting shaft 14 by a thrust generated by the propeller 9, thereby causing the steel ball 29 of the thrust receiver 25 to abut against an abutment surface $\mathbf{24}_{11}$ of the output rod $\mathbf{24}_1$ of the trim cylinder 24. Thus, the outboard engine body O can be slightly swung about the tilting shaft 14 to adjust the trim angle by contracting the trim cylinder 24. When the tilting cylinder 18 is expanded to tilt up the outboard engine body O, the steel ball 29 is moved away from the output rod $\mathbf{24}_1$ of the trim cylinder 24, as shown in FIG. 3.

When the trim cylinder 24 is expanded, the abutment surface $\mathbf{24}_{11}$ of the output rod $\mathbf{24}_1$ is moved on a substantially straight line, and the steel ball 29 is moved in an arc of a circle about the tilting shaft 14. Therefore, the steel ball 29 and the abutment surface $\mathbf{24}_{11}$ are moved relative to each other with the expansion and contraction of the trim cylinder 24. By the rolling movement of the steel ball 29 on the abutment surface $\mathbf{24}_{11}$ generation of an unusual sound is reduced and wearing of the parts is reduced.

A vibration from the engine E and thrust of the engine E are applied to the abutment area between the output rod $\mathbf{24}_1$ of the trim cylinder 24 and the steel ball 29. However, even if vibration and thrust are applied to the abutment area, chattering cannot be generated between the mounting shaft portion $\mathbf{28}_1$ and the swivel case 15, since both the mounting shaft portion $\mathbf{28}_1$ and the swivel case 15 are smoothly placed into abutment against each other, because the first tapered surface $\mathbf{28}_{11}$ of the mounting shaft portion $\mathbf{28}_1$ of the thrust receiver body 28 has been wedged to the second tapered surface $\mathbf{15}_{11}$ of the mounting hole $\mathbf{15}_1$ in the swivel case 15.

In mounting and removing the thrust receiver 25 from the swivel case 15 for assembling and maintenance of the outboard engine system, even if the nut 27 is turned, the thrust receiver body 28 cannot be rotated along with the nut 27, leading to an enhanced workability, because the notches $\mathbf{28}_{31}$, $\mathbf{28}_{31}$ of the flange $\mathbf{28}_3$ are in engagement with the detent projections $\mathbf{15}_2$, $\mathbf{15}_2$ of the swivel case 15. The notches $\mathbf{28}_{31}$, $\mathbf{28}_{31}$ and the detent projections $\mathbf{15}_2$, $\mathbf{15}_2$ constitute a detent means of the present invention.

Figure 6:
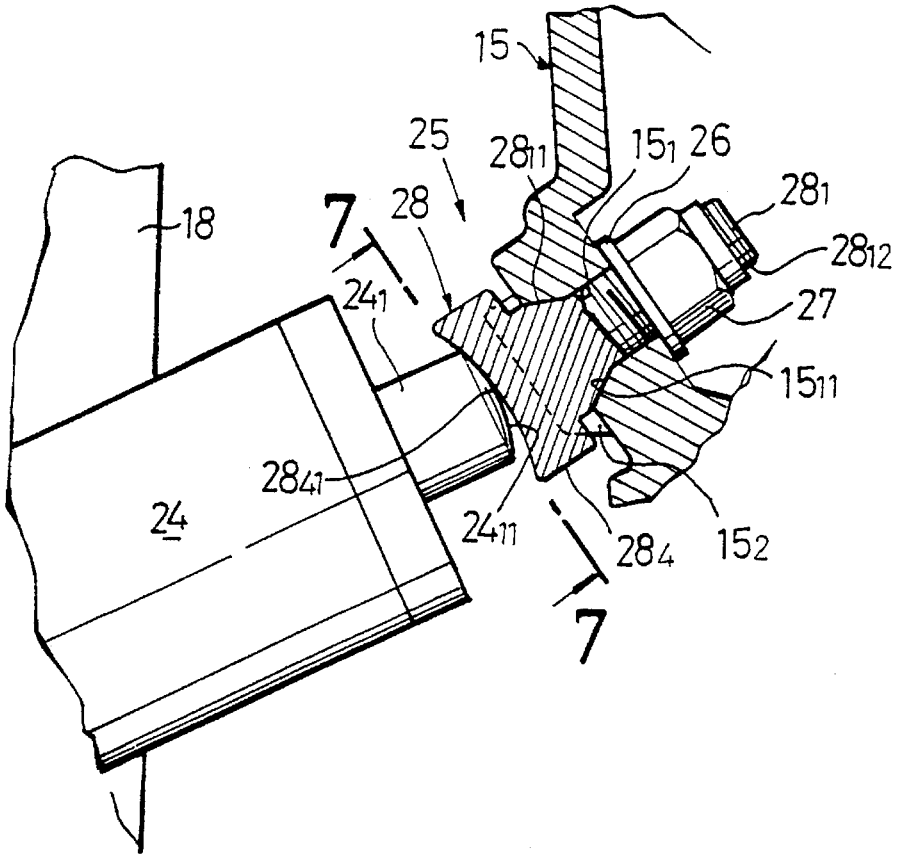
FIG. 6 is a view similar to FIG. 4, but illustrating a second embodiment.
Figure 7:
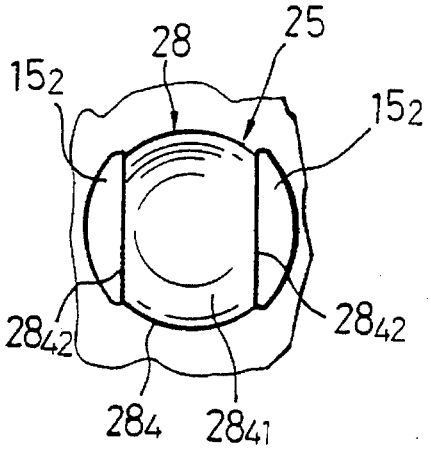
FIG. 7 is a view taken along a line 7—7 in FIG. 6.

A second embodiment of the present invention will now be described with reference to FIGS. 6 and 7.

In the second embodiment, the thrust receiver 25 has no steel ball 29, and the shape of the thrust receiver body 28 is different from that in the first embodiment. More specifically, a head $\mathbf{28}_4$, connected to the front portion of the first tapered surface $\mathbf{28}_{11}$ of the thrust receiver body 28, has a load bearing surface $\mathbf{28}_{41}$ which is depressed into a partially spherical surface-like configuration. The abutment surface $\mathbf{24}_{11}$ of the output rod $\mathbf{24}_1$ of the trim cylinder, which abuts against the load bearing surface $\mathbf{28}_{41}$, projects into a spherical surface-like shape. The radius of curvature of the load bearing surface $\mathbf{28}_{41}$ is set larger than that of the abutment surface $\mathbf{24}_{11}$. Thus, when the trim cylinder 24 is expanded or contracted, the load bearing surface $\mathbf{28}_{41}$ and the abutment surface $\mathbf{24}_{11}$ can be placed into smoothly sliding contact with each other, thereby reducing the generation of an unusual sound and reducing wear on the parts.

The head $\mathbf{28}_4$ of the thrust receiver body 28 has a pair of left and right notches $\mathbf{28}_{42}$, $\mathbf{28}_{42}$. Thus, when the nut 27 is turned for assembling and maintenance of the outboard engine system, the thrust receiver body 28 can be prevented from being rotated along with the nut 27 by engagement of the notches $\mathbf{28}_{42}$, $\mathbf{28}_{42}$ with the detent projections $\mathbf{15}_2$, $\mathbf{15}_2$ of the swivel case 15. The notches $\mathbf{28}_{42}$, $\mathbf{28}_{42}$ and the detent projections $\mathbf{15}_2$, $\mathbf{15}_2$ constitute a detent means of the present invention.

Even in the second embodiment, the mounting shaft portion $\mathbf{28}_1$ and the swivel case 15 can be smoothly placed into abutment against each other without chattering, because the first tapered surface $\mathbf{28}_{11}$ of the thrust receiver body 28 has been wedged to the second tapered surface $\mathbf{15}_{11}$ of the swivel case 15.

Although the embodiments of the present invention have been described in detail, it will be understood that the present invention is not limited to the above-described embodiments, and various modifications in design may be made without departing from the spirit and scope of the invention defined in claims.

For example, in place of the nut 27 to fix the thrust receiver body 28, another fixing means such as a clip may be used. In addition, in place of supporting the trim cylinder 24 on the tilting cylinder 18, the trim cylinder 24 may be fixed to the stern bracket 11 directly or through a bracket. Further, if a ceramic ball is used in place of the steel ball 29, wear and corrosion resistances can be further enhanced.

What is claimed:

1. A trim system for an outboard engine system, comprising:

a stern bracket having a tilting shaft;

a swivel case having a) a mounting hole formed in said swivel case, b) a swivel shaft mounted in the swivel case and c) a thrust receiver mounted on the swivel case, an outboard engine body being pivotally supported through said swivel shaft, such that said outboard engine body can be laterally steered, and said swivel case is vertically swingably supported on said stern bracket through said tilting shaft; and a trim cylinder mounted on said stern bracket, said trim cylinder having an output rod provided thereon to abut against said thrust receiver which is mounted on said swivel case, wherein said thrust receiver includes a mounting shaft portion to be inserted into said mounting hole formed in said swivel case, said mounting shaft having a first tapered surface formed thereon and reduced in diameter in a direction away from said output rod of said trim cylinder, said mounting hole having a second tapered surface formed therein, said first tapered surface being wedged to said second tapered surface, and wherein said thrust receiver is prevented from being rotated relative to said swivel case by a detent means provided between said thrust receiver and said swivel case.

2. A trim system according to claim 1, wherein said thrust receiver is fixed to said swivel case by a nut threadedly fitted to said mounting shaft portion.

3. A trim system according to claim 1, further comprising a ball supporting portion integrally formed at a front portion of said first tapered surface of said mounting shaft, and a ball rotatably retained by said ball supporting portion.

4. A trim system according to claim 3, further comprising a flange integrally formed around a periphery of the ball supporting portion and including a pair of notches on opposite sides of said flange, said notches forming part of said detent means.

5. A trim system according to claim 1 further comprising a head connected to a front portion of the first tapered surface, said head having a load bearing surface formed into a partially spherical configuration.

6. A trim system according to claim 5 wherein said output rod of said trim cylinder having an abutment surface which abuts against said load bearing surface of said thrust receiver.

7. A trim system according to claim 6 wherein said abutment surface of said output rod has a spherical shape.

8. A trim system according to claim 7 wherein a radius of curvature of said load bearing surface is larger than a radius of curvature of said abutment surface.

9. A trim system according to claim 1 wherein said output rod of said trim cylinder having an abutment surface which abuts against a load bearing surface of said thrust receiver.

10. A trim system according to claim 1, wherein said detent means comprises detent projections provided on said swivel case around said mounting hole and notches provided on said thrust receiver for engagement with said projections in a circumferential direction of the mounting hole.

11. A trim system according to claim 1, wherein said first and second tapered surfaces are of shapes fully complementary to each other.

* * * * *